United States Patent [19]

Foret et al.

[11] 4,283,302

[45] Aug. 11, 1981

[54] PARTICULATE BLEACH COMPOSITIONS

[75] Inventors: Roger Foret, Haubourdin, France; Philippus C. van der Hoeven, Prinsenbeek, Netherlands

[73] Assignee: Lever Brothers Company, New York, N.Y.

[21] Appl. No.: 166,639

[22] Filed: Jul. 7, 1980

[30] Foreign Application Priority Data

Jul. 6, 1979 [GB] United Kingdom ..... 23765/79

[51] Int. Cl.[3] ..... C11D 7/54

[52] U.S. Cl. ..... 252/102; 252/95; 252/99; 252/186; 8/111

[58] Field of Search ..... 252/102, 99, 186, 95; 8/111

[56] References Cited

U.S. PATENT DOCUMENTS

| | | | |
|---|---|---|---|
| 4,009,113 | 2/1977 | Green et al. | 252/102 X |
| 4,064,062 | 12/1977 | Yurko | 252/95 X |
| 4,087,369 | 5/1978 | Wevers | 252/102 |

*Primary Examiner*—Mayer Weinblatt
*Attorney, Agent, or Firm*—Melvin H. Kurtz

[57] ABSTRACT

Particulate bleach (and detergent) compositions with improved bleach efficiency are disclosed comprising a particulate peroxybleach compound and tetraacetyl ethylene diamine (TAED), said TAED having the following particle size distribution as determined by sieve analysis:

0–20% > 150 μm

10–100% > 100 μm < 150 μm

0–50% < 75 μm

0–20% < 50 μm, and being contained in granules in combination with a granulating agent, said granules having particle size ranging from 100–2000 μm and comprising 10–99% by weight of TAED. The particulate bleach composition does not suffer from significant sedimentation and/or dissolution problems and does not suffer from significant decomposition problems during storage.

6 Claims, No Drawings should not contain more than 50% by weight of particles with a size of less than 30 μm. Advantageously the TAED fraction should contain not more than 50%, preferably not more than 30% by weight of particles with a size of less than 75 μm and not more than 20%, preferably not more than 10% by weight of particles of a size less than 50 μm. TAED becomes very difficult to handle during processing if a major proportion of it is very fine (40–50μ or less). Also control of the granulation process and of the resulting granule size distribution is difficult if the TAED particle size distribution is very wide. On the other hand, the TAED fraction used may contain a certain amount of particles of a size, >150 μm, but it should not contain more than 20% by weight of particles >150 μm. It is to be understood that these particle sizes refer to the TAED present in the granules, and not to the granules themselves. The latter have a particle size ranging from 100–2000 μm, the major part of it ranging from 100 to 1000 μm, preferably 500 to 900 μm. Though up to 5% by weight of granules with a particle size of <100 μm may be tolerable, a lower limit of 100 μm on the granule size is set by storage stability so as to exclude ungranulated material.

Accordingly, the activator granules of the present invention contain tetraacetyl ethylene diamine (TAED) of the following particle size distribution as determined by sieve analyses:

0–20% > 150 μm

10–100% > 100 μm < 150 μm

0–50% < 75 μm

0–20% < 50 μm

Preferred TAED has particle size distribution:

0–10% > ⅛ μm

15–85% > 100 μm < 150 μm

0–30% < 75 μm

0–10% < 50 μm.

The granules may be obtained by granulation with a suitable carrier material, such as granular sodium triphosphate/potassium triphosphate mixtures with TAED particles of the required size. Other granulation methods using organic and/or inorganic granulation agents can also be usefully applied, such as tetrasodium pyrophosphate, disodium orthophosphate, gelatin, dextrin, sodium carboxymethyl cellulose, nonionic ethylene oxide condensation products, each alone or in combination. A preferred granulation/binder system is a mixture of sodium triphosphate and potassium triphosphate, which is applied by preparing a pre-mix of solid finely divided sodium triphosphate with TAED, on to which potassium triphosphate is sprayed as a saturated aqueous solution during the granulation process, e.g. in a rotating pan granulator. The granules can be subsequently dried, if required. Basically, any granulation process is applicable, as long as the granule contains TAED of the required particle size, and as long as the other materials, present in the granule, do not negatively affect the activator. Suitable granulation equipments are e.g. rotating pan granulators and the Schugi Flexomix, both equipments working on a principle of spraying a liquid agent on to a moving mass of solid particles to effectuate granulation of the particles.

It is to be observed here that in U.S. patent specification 4,087,369 it is proposed to use a particulate crystalline peroxybleach activator having a much greater mean particle size, i.e. in the range from about 500–1800 μm. It is stated in this U.S. patent that the lower particle diameter appears to be critical inasmuch as particle size of less than 500 μm are prone to a markedly decreased storage stability.

In contrast to this teaching, it is highly surprising that this problem does not occur when using TAED of a substantially smaller mean particle size according to the invention.

The peroxybleach compound, used in the present invention, need not have the same particle size as that of the activator, and in fact it is preferable that the peroxybleach has a different, bigger particle size than the activator in order to prevent segregation.

The granules, which contain the TAED of the required particle size, will contain said TAED in an amount of 10 to 99% by weight, preferably 40 to 90% by weight. The bleach composition will contain the granules in an amount, calculated as TAED, of 0.25 to 50% by weight, preferably 1 to 40% by weight.

The peroxybleach compound will be used in the present invention in an amount of 3 to 99.5% by weight, preferably 4 to 80% by weight. Typical examples of suitable peroxybleach compounds releasing active oxygen in aqueous solution are the alkalimetal perborates, -percarbonates, -persilicates and -perpyrophosphates. Particularly preferred are the alkalimetal perborates, such as sodium perborate tetrahydrate and sodium perborate monohydrate, because of their commercial availability.

Accordingly, in a more specific embodiment of the invention a bleaching composition will comprise 3 to 99.5%, preferably 4 to 80% by weight of a particulate peroxy bleach compound, and 0.25 to 50%, preferably 1 to 40% by weight of TAED, having the following particle size distribution as determined by sieve analysis:

0–20% > 150 μm

10–100% > 100 μm < 150 μm

0–50% < 75 μm

0–20% < 50 μm, said TAED being contained in granules, in combination with a granulating agent, said granules comprising 10–99%, preferably 40–90% by weight of said TAED.

Preferably the bleach composition of the invention comprises a stabilising agent for peracids. Suitable stabilising agents include the organic phosphonic acid compounds such as ethylene diamine tetra(methylene phosphonic acid), and diethylene tri-amine penta-(methylene phosphonic acid). They can be used as such or as their water-soluble salts or as their complexes with calcium, magnesium, zinc or aluminium. These stabilising agents may be incorporated in the detergent slurry before spray-drying or, as desired, be dry mixed with the bleach composition or co-granulated with the TAED. The amount of stabilising agent used in the present invention is usually 0.05–5% by weight, preferably 0.1 to 3% by weight based on the total composition.

PARTICULATE BLEACH COMPOSITIONS

This invention relates to particulate bleach compositions with improved bleach efficiency. More particularly it relates to particulate bleach compositions which contain a peroxybleach compound and an organic activator for this peroxybleach compound. Such bleach compositions are also active at lower temperatures, i.e. in the range from ambient temperature to about 60° C. Such bleach compositions, also referred to as low-temperature bleach compositions, are known in the art. They normally comprise an inorganic persalt releasing active oxygen in solution, hereafter called for the purpose of this invention a peroxybleach compound, such as sodium perborate and an activator therefor, which is usually an organic compound having one or more reactive acyl residues, which at relatively low temperatures react with the peroxybleach compound causing the formation of organic peracids, the latter providing for a more effective bleaching action at lower temperatures than the peroxybleach compound. These low-temperature bleach compositions are more fully described in e.g. British Pat. Specifications Nos. 836,988, 855,735, 907,356, 907,358 an 1,003,310. The best-known organic activator of practical importance is N,N,N',N'-tetraacetyl ethylene diamine, normally referred to as simply tetraacetyl ethylene diamine and coded TAED.

The present invention is concerned with the use of N,N,N',N'-tetraacetyl ethylene diamine as the activator for peroxybleach compounds.

Although such bleach compositions can provide for acceptable bleach efficiency, it has been determined in fabric washing machine operations that the bleach efficiency is generally less than one would expect on the basis of the relative amounts of peroxybleach and activator used. Further investigation has shown that in many instances a substantial amount of the activator remains ineffective, due to sedimentation in the bleach-/wash-liquor, and/or a relatively slow rate of dissolution. This phenomenon of material loss during the wash is referred to hereinafter as sedimentation mechanical loss. It concerns that part of the particulate product which is first dispersed in the water inside the machine but which sediments there and largely remains ineffective during the whole washing/bleaching process.

Also decomposition of the activator may occur during storage of the particulate bleach composition.

The present invention serves to mitigate the above problems to a substantial degree.

Some of these problems have been recognised in the art and various attempts have been made to solve them, without great success.

British Pat. Specification No. 864,798 deals with the use of certain organic esters of carboxylic acids, e.g. sodium acetoxybenzene sulphonate, in granular form as activator for inorganic persalts. A disadvantage of these esters is that they tend to (per-)hydrolyse more readily than tetraacetyl ethylene diamine, the activator used in the present invention, and hence suffer from a more severe decomposition problem during storage.

In U.S. Pat. Specification No. 4,087,369 it is proposed to provide the activator in coarse crystalline form having a mean particle diameter in the range of 500–1800 micrometers or as agglomerates of the same mean particle diameter. Though this may reduce the decomposition problem of tetraacetyl ethylene diamine, it does not solve and may even increase the more severe problem of sedimentation loss and/or insolubility.

In British Pat. Specification No. 1,459,974 a bleach composition is described, comprising a mixture of sodium perborate and activator in finely divided form so as to provide for rapid dissolution thereof. Such a composition, however, will suffer from a serious decomposition problem during storage. Being a mere mixture of fine materials, it tends to give handling, segregation and storage decomposition problems when used in a particulate detergent composition.

U.S. Pat. No. 4,064,062 discloses a bleaching composition comprising a mechanical mixture of a finely divided sodium perborate tetrahydrate, a finely divided activator; e.g. "BHAT", and finely divided solid fatty acid of average particle diameter in the 44 to 149 micrometer range, and a molecular sieve zeolite. A bleaching composition of this description comprising TAED has poor storage stability.

British Pat. No. 1,395,006 discloses particulate bodies, each comprising a dispersible composite particle containing finely divided activator material, e.g. tetraacetyl ethylene diamine (TAED) passing mesh size of 0.10 mm provided with a coherent protective layer. The activator according to this patent is desirably of as small a particle size as possible and should preferably pass a mesh of 0.05 mm (50 μm). Such fine TAED would be very difficult to handle during processing and does not give satisfactory granules when granulated according to the simple granulation techniques. Moreover, products of this description, while possibly being protected from the environment, will tend to sediment in the washing machine due to their solid and heavy construction.

It is therefore an object of the present invention to provide an improved low-temperature bleach composition comprising a peroxy bleach compound and tetraacetyl ethylene diamine as the activator therefor, which does not suffer from significant sedimentation and/or dissolution problems, and simultaneously does not suffer from significant decomposition problems during storage.

This and other objects, which will be apparent in the further description of the invention, have now been found possible to achieve by using tetraacetyl ethylene diamine (TAED) in granular form, the granules containing TAED of a critical, special particle size as defined hereinafter.

In its broadest sense, the invention therefore relates to a particulate bleach composition comprising a particulate peroxybleach compound and tetraacetyl ethylene diamine as activator therefor, the latter being contained in granules with a granulating agent, the granules containing said tetraacetyl ethylene diamine of a critical particle size which will be defined in more detail hereafter.

It has been found that if the average particle size of the TAED is less than 150 μm (micrometer), a very significant improvement in bleach efficiency is obtained. The sedimentation losses, when using TAED with an average particle size of less than 150 μm, are substantially decreased. Even better bleach performance is obtained if the average particle size of the TAED is $<100$ μm. However, too small a particle size entails certain drawbacks, such as a certain decomposition, dust-formation and handling problems, and although particle sizes below 100 μm can provide for an improved bleaching efficiency, the TAED fraction The bleach composition of the invention may consist solely of the peroxy bleach compound in admixture with the TAED granules, or preferably it may in addition thereto contain other ingredients so as to form a detergent bleach composition suitable for use in household and industrial washing machines. Thus it may contain from 2–20% by weight of one or more of a detergent active compound selected from the group consisting of fatty acid soaps, anionic, nonionic, amphoteric and zwitterionic detergent active materials and mixtures thereof.

Examples of anionic detergent compounds are alkylaryl sulphonates (e.g. sodium dodecylbenzenesulphonate); products of the sulphonation of olefins, so-called olefinsulphonates; fatty alcohol sulphonates; alkylether sulphates, in the form of their alkali metal salts, and alkali metal salts of long chain $C_8$–$C_{22}$ fatty acids.

Nonionic detergent compounds can be broadly defined as compounds produced by the condensation of alkylene oxide groups with an organic hydrophobic compound which may be aliphatic or alkylaromatic in nature. The length of the polyalkylene oxide group which is condensed with any particular hydrophobic group can be readily adjusted to yield a water-soluble compound having the desired degree of balance between hydrophilic and hydrophobic elements. Examples of suitable nonionic detergent compounds are the condensation products of $C_6$–$C_{12}$ alkylphenols with 5–25 moles of ethylene oxide per mole of alkylphenol; the water-soluble condensation products of $C_8$–$C_{22}$ aliphatic alcohols, either straight or branched chained, with 5–30 moles of ethylene oxide per mole of alcohol.

Amphoteric detergents include derivatives of aliphatic or aliphatic derivatives of heterocyclic secondary or tertiary amines in which the aliphatic moiety can be straight-chain or branched and wherein one of the aliphatic substituents contains from 8 to 18 carbon atoms and at least one aliphatic substituent contains an anionic water-solubilizing group.

Zwitterionic detergents include derivatives of aliphatic quaternary ammonium, phosphonium and sulphonium compounds in which the aliphatic moieties can be straight-chain or branched, and wherein one of the aliphatic substituents contains from 8 to 18 carbon atoms and one contains an anionic water-solubilizing group.

Other detergent-active materials are described in the books "Surface-Active Agents and Detergents" Vol. I and II by Schwartz, Perry and Berch (published by Interscience).

Furthermore, the composition of the invention may contain from 10 to 60% by weight of one or more of a detergency builder material. Examples of such detergency builders are sodium and potassium triphosphate, sodium orthophosphate, sodium and potassium pyrophosphate, sodium carbonate, sodium silicate, zeolites and other organic non-phosphate builders, such as nitrilotriacetate acid and its water-soluble salts, sodium ethylene diamine tetraacetate, carboxymethyloxymalonate, carboxymethyloxysuccinate, sodium citrate, polyelectrolytes, etc. In addition and if desired further ingredients commonly used in such compositions may be incorporated, such as buffers, hydrotropes, corrosion inhibitors, soil-suspending and anti-redeposition agents, e.g. sodium carboxymethylcellulose, polyvinylpyrrolidon, lather boosters, lather depressors, sequestering agents, bactericides, softening agents, perfumes, colouring agents and enzymes, particularly proteolytic enzymes, such as those known under the tradenames Alcalase® ex Novo Industri A/S Copenhagen; Maxatase® ex Gist-Brocades N.V. Delft; and high-alkaline proteases such as those described in British Patent Specification 1,243,784. Examples of high alkaline proteases are sold under the tradenames Esperase® and Savinase®.

In such detergent bleach composition the proportion of TAED will generally be in the range of 0.25–15% by weight, preferably from 1–10% by weight.

The proportion of peroxybleach compound will generally be in the range of 3–30% by weight, preferably from 4–20% by weight.

The invention will now be illustrated by way of the following Examples.

EXAMPLE 1

Bleaching tests were carried out with a composition given below in a commercial washing machine under the following conditions:

Wash temperature: 60° C. (main wash only)
Wash load: Clean loads (4 kg of cotton)
Water hardness: 7°–8° GH (tap water)
Dosage of composition: 100 g per cycle.
Number of repeats:
(a) Mechanical loss of activator: 3 repeats
(b) Bleaching efficiency on tea-stained test-cloths: 5 repeats.

The bleaching efficiency (ΔR) was measured by reflectance measurements, using an Elrephometer with a 420 nm filter, and the mechanical loss was measured by standard concentration measurement.

| Composition | % by weight |
|---|---|
| $C_{12}$-alkylbenzene sulphonate | 7 |
| Tallow fatty alcohol, condensed with 25 moles of ethylene oxide | 1.35 |
| 11–13 Fatty alcohol, condensed with 13 moles of ethylene oxide | 1 |
| Sodium stearate | 4 |
| Sodium tripolyphosphate | 36 |
| Sodium silicate | 6 |
| Sodium carboxymethylcellulose | 1 |
| Magnesium ethylenediamine tetraacetate | 0.12 |
| Fluorescer | 0.25 |
| Sodium sulphate | 16.23 |
| Sodium perborate | 12 |
| Tetraacetyl ethylene diamine (TAED) | 3 |
| Ethylene diamine tetramethyl phosphonic acid | 0.3 |
| Enzyme noodles | 1.6 |
| Perfume | 0.15 |
| Water | 10. |

The TAED was added to this composition by dry mixing in the form of granules.

These granules were prepared batchwise in an 0.5 meter rotating pan granulator by charging a premix of TAED and sodium triphosphate (STP), on to which a hot (50° C.) potassium triphosphate (KTP) solution (48% W/W) was sprayed. The granules were then dried off in a fluid bed drier at approximately 55° C.

TAED granules A were of mean particle size of 700–900 μm and contained TAED of which the main portion has particle size <104 μ, having the following sieve analysis:

| Sieve size (μm) | % retained on each sieve |
|---|---|
| 150 | 0.5 |
| 125 | 9.8 |

-continued

| Sieve size (μm) | % retained on each sieve |
|---|---|
| 90 | 40.2 |
| 63 | 20.1 |
| 45 | 26.1 |
| <45 | 3.3 |

Granule A composition:
TAED—60.0%
STP—18.1%
KTP—18.0%
Water—3.9% (as bound water).

TAED granules B were of mean particle size of 700–900 μm and contained TAED of average particle size between 104μ and 150 μm and had the following composition:
TAED—61.4%
STP—21.1%
KTP—14.1%
Water—3.4% (as bound water).

TAED granules C were of mean particle size of 700–900 μm and contained TAED, obtained from a mixture of 50% TAED as used in granules B+50% TAED as used in granules A.

Granule C composition:
TAED—59.6%
STP—20.6%
KTP—14.9%
Water—4.9% (as bound water).

As control, TAED granules, having a particle size of approximately 800 μm (±100μ). (15–20%>1000 μm and about 20%≦400 μm) and containing TAED of average particle size of about 250 μm, were used.

Control granule composition:
TAED—65%
STP—21%
KTP—8%
Water—6% (as bound water).

These granules were dosed in such an amount in the above detergent composition to provide for 3% TAED in the composition, yielding four compositions A, B, C and the control. The results of the experiments are given below.

| | A | B | C | Control |
|---|---|---|---|---|
| *Total mechanical loss at 40° C. | 42 | 45 | 53 | 72 |
| Total mechanical loss at end wash | 37 | 41 | 50 | 64 |
| Sedimentation mechanical loss at 40° C. | 27 | 29 | 40 | 65 |
| ΔR | 15.4 | 13.5 | 14.7 | 9.6 |

*Total mechanical loss is the sum of sedimentation loss and direct mechanical loss which concerns that part flowing directly from the dispenser to the drain of the washing machine at the very beginning of the water intake.

These results show a reduced loss of TAED, and an improved bleach efficiency, compared with the control TEAD granulate.

EXAMPLE 2

The following compositions were tested in four different washing machines, under the following conditions:

Wash temperature: ±60° C. (main wash only)
Wash load: Naturally soiled loads (4 kg of cotton)
Water hardness: 7°–8° GH
Dosage of composition: 150 g per cycle.

The bleaching efficiency (ΔR) was determined as in Example 1, and the results are the average of those obtained in the 4 different washing machines. The control contained the control granules of Example 1, and the TAED granules A were those of Example 1.

Results in soiled system (Average results in 4 different washing machine models).

Composition I

| | | | | |
|---|---|---|---|---|
| % TAED in detergent: | 1.47 | 1.85 | 2.60 | 2.98 |
| Δ R control | 5.1 | 4.8 | 10.2 | 10.8 |
| % TAED in detergent: | 1.31 | 1.64 | 2.31 | 2.65 |
| Δ R TAED granules A | 7.7 | 7.7 | 14.5 | 13.1 |

A comparison per column indicates that in spite of a lower TAED content the formulation containing the granules A gave better bleaching results on tea stains than the control.

Composition II

| | 1 | 2 | 3 | 4 |
|---|---|---|---|---|
| % TAED in detergent | 0.97 | 1.26 | 1.55 | 1.85 |
| Δ R control | 2.8 | 5.0 | 5.4 | 8.3 |
| % TAED in detergent | 0.86 | 1.17 | 1.64 | 1.90 |
| Δ R TAED granules A | 4.3 | 6.8 | 9.1 | 10.1 |

In spite of a lower TAED content (columns 1 and 2) the granules A gave a better bleaching efficiency than the control. A slightly higher TAED content gave a proportionally much higher bleach efficiency.

| Composition I | % by weight |
|---|---|
| $C_{12}$-alkylbenzene sulphonate | 7 |
| Tallow fatty alcohol, condensed with 25 moles of ethylene oxide | 1.35 |
| $C_{11}$–$C_{13}$ alcohol condensed with 13 moles of ethylene oxide | 1 |
| Sodium stearate | 4 |
| Sodium tripolyphosphate | 34.7 |
| Alkaline sodium silicate | 5.25 |
| Fluorescer | 0.17 |
| Sodium carboxymethyl cellulose | 0.7 |
| Ethylene diamine tetraacetate | 0.12 |
| Sodium sulphate | 11.41 |
| Ethylene diamine tetra(methylene phosphonic acid) | 0.3 |
| Water | 10 |
| Sodium perborate | 6 |
| Enzyme noodles | 2.25 |
| TAED (expressed as pure TAED) from 1.40 to 2.98% (see Table of results) $Na_2SO_4$ | ad 100. |

| Composition II | % by weight |
|---|---|
| $C_{12}$-alkylbenzene sulphonate | 7.5 |
| Sodium stearate | 5.0 |
| Neutral sodium silicate | 6.0 |
| Fluorescer | 0.2 |
| Sodium sulphate | 15.66 |
| Ethylene diamine tetraacetate | 0.2 |
| Tallow fatty alcohol condensed with 18 moles of ethylene oxide | 3.0 |
| Prehydrated sodium tripolyphosphate | 34.1 |
| Sodium carboxymethyl cellulose | 1.0 |
| Ethylene diamine tetra(methylene phosphonic acid) | 0.36 |
| Sodium perborate | 6 |
| Enzyme noodles | 2.25 |
| TAED (expressed as pure TAED) from 0.92 to 2.4% (see Table of results) | |
| Sodium sulphate | ad 100. |

EXAMPLE 3

Storage stabilities of TAED, sodium perborate and fluorescent agent were examined in a mixed active detergent base powder composition to which 3% TAED and 10% sodium perborate tetrahydrate were added.

| Mixed active detergent base powder composition | Parts by weight |
|---|---|
| $C_{12}$-alkylbenzene sulphonate | 5.2 |
| $C_{11-13}$ alcohol condensed with 12–18 moles of ethylene oxide | 5.2 |
| Sodium triphosphate | 34.0 |
| Alkaline sodium silicate | 4.0 |
| Sodium carboxymethyl cellulose | 0.8 |
| Magnesium silicate | 0.5 |
| Tetrasodium ethylene diamine tetraacetate | 0.17 |
| Fluorescer | 0.14 |
| Sodium sulphate | 12.0 |
| Water | 8.3 |
| Ethylene diamine tetra(methylene phosphonic acid) | 0.3 |

The storage results using different types of TAED are given below:

| | % residual after 4 weeks at 37° C./70% RH | | |
|---|---|---|---|
| TAED type: | TAED | Perborate | Fluorescer |
| I (granulated) | 87 | 92 | 84 |
| II (ungranulated) | 16 | 42 | 30 |
| II (granulated) | 50 | 69 | 60 |
| III (granulated) | 72 | 70 | 89 |

TAED type I was TAED of particle size distribution as used in granules A of Example 1.

TAED type II had the following particle size distribution:

8.2%—>90 μm 8.7%—63–90 μm 13.3%—45–63 μm 40.3%—38–45 μm 29.6%—<38 μm.

TAED type III was coarse TAED of mean particle size of 250–300 μm.

From the above results it can be seen that the composition containing granulated TAED type I according to the invention shows an improved overall stability with respect to TAED, sodium perborate and fluorescer, as compared with the compositions outside the invention using granulated or ungranulated TAED type II and an at least equal overall stability as compared with the composition containing granulated TAED type III.

We claim:

1. A particulate bleach composition comprising 3–99.5% by weight of a particulate inorganic peroxybleach compound, and 0.25–50% by weight of tetraacetyl ethylene diamine (TAED), said TAED having the following particle size distribution as determined by sieve analysis:

0–20%<150 μm

10–100%>100 μm<150 μm

0–50%<75 μm

0–20%<50 μm and being contained in granules in combination with a granulating agent selected from the group consisting of an organic and inorganic carrier material said granules having a particle size ranging from 100 to 2000 μm and comprising 10–99% by weight of said TAED.

2. A particulate bleach composition according to claim 1, wherein said granules contain tetraacetyl ethylene diamine of particle size distribution:

0–10%>150μ

15–82%>100μ<150 μm

0–30%<75 μm

0–10%<50 μm.

3. A particulate bleach composition according to claim 1, which further contains a stabilising agent selected from the group consisting of ethylene diamine tetra(methylene phosphonic acid), diethylene triamine penta(methylene phosphonic acid) and water-soluble salts thereof, in an amount of 0.05–5% by weight.

4. A particulate bleach composition according to claim 1, wherein said peroxy bleach compound is sodium perborate.

5. A particulate bleach composition according to claim 1, wherein said granulating agent is a mixture of sodium triphosphate and potassium triphosphate.

6. A particulate bleach composition consisting essentially of:

(a) 2–20% by weight of a detergent active compound, selected from the group consisting of alkali metal salts of long chain $C_8$–$C_{22}$ fatty acids, anionic sulphonate or sulphate detergent compounds and nonionic alkylene oxide condensation products and mixtures thereof;

(b) 10–60% by weight of a detergency builder material, selected from the group consisting of inorganic phosphates, carbonates, silicates, zeolites and organic non-phosphate builders, and mixtures thereof;

(c) 3–30% by weight of an inorganic peroxy bleach compound:

(d) 0.25–15% by weight of tetraacetyl ethylene diamine (TAED), said TAED having the following particle size distribution as determined by sieve analysis:

0–20%>150 μm

10–100%>100 μm<150 μm

0–50%<75 μm

0–20%<50 μm and being contained in granules with an organic and/or inorganic carrier material as granulating agent, said granules having a particle size ranging from 100 to 2000 μm and comprising 10–99% by weight of TAED; and (e) 0–5% by weight of a stabilizing agent selected from the group consisting of ethylene diamine tetra-(methylene phosphonic acid), diethylene triamine penta-(methylene phosphonic acid) and water-soluble salts thereof.

* * * * *

UNITED STATES PATENT AND TRADEMARK OFFICE

CERTIFICATE OF CORRECTION

PATENT NO. : 4,283,302

DATED : August 11, 1981

INVENTOR(S) : Roger Foret, Phillippus C. van der Hoeven

It is certified that error appears in the above-identified patent and that said Letters Patent are hereby corrected as shown below:

Column 3, line 38 change 0-10% > 1/8 μm to --0-10% > 150 μm--

In the Claims:

Column 9, Claim 1, line 59 change 0-20% < 150 μm to --0-20% > 150 μm--

Signed and Sealed this

Second Day of March 1982

[SEAL]

Attest:

GERALD J. MOSSINGHOFF

Attesting Officer

Commissioner of Patents and Trademarks